US005975658A

United States Patent [19]

Verbeek et al.

[11] Patent Number: 5,975,658

[45] Date of Patent: Nov. 2, 1999

[54] FILE STORAGE TOWER STRUCTURE

[75] Inventors: Steve Verbeek, Aurora; John Hellwig, Toronto; Lee Hewitt, Brampton, all of Canada

[73] Assignee: Teknion Furniture Systems Limited

[21] Appl. No.: 09/092,038

[22] Filed: Jun. 5, 1998

[51] Int. Cl.[6] ..... A47B 81/00

[52] U.S. Cl. ..... 312/209; 312/280; 312/249.11

[58] Field of Search ..... 312/280, 209, 312/249.8, 297, 100, 187, 231, 230, 293.1, 223.3, 249.11, 249.13; 108/50.01, 137; 144/286.1

[56] References Cited

U.S. PATENT DOCUMENTS

| | | | |
|---|---|---|---|
| 1,471,712 | 10/1923 | Sohnle | 312/280 X |
| 2,503,807 | 4/1950 | Dolas | 312/231 |
| 3,423,144 | 1/1969 | Patterson | 312/280 |
| 3,708,709 | 1/1973 | Morrison et al. | 312/209 |
| 4,114,965 | 9/1978 | Oye et al. | 312/209 |
| 4,518,208 | 5/1985 | Marder | 312/209 |
| 4,588,237 | 5/1986 | Marder | 312/209 |
| 4,612,863 | 9/1986 | Vonhausen et al. | 708/50.01 X |
| 4,790,610 | 12/1988 | Welch et al. | 312/209 X |
| 5,623,881 | 4/1997 | Huang | 108/50.01 |
| 5,655,905 | 8/1997 | Jaines et al. | 312/209 X |
| 5,702,115 | 12/1997 | Pool | 312/209 X |

FOREIGN PATENT DOCUMENTS

| | | | |
|---|---|---|---|
| 2244670 | 12/1991 | United Kingdom | 144/286.1 |
| 94/13250 | 6/1994 | WIPO | 312/209 |

OTHER PUBLICATIONS

"The elite bedside cabinet" from Hill–Rom, Catalog, 6 pages.

Waterloo storage & delivery systems catalog, Sep. 1994.

Corporate express office products catalog, p. 59, Nov. 1996.

*Primary Examiner*—Peter M. Cuomo

*Assistant Examiner*—James O. Hansen

[57] ABSTRACT

A file tower structure is disclosed and has a rail configuration at the top thereof for hanging of office accessories to the exterior thereof. The office accessories can be stored within the file structure when not in use. Preferrably the file structure is mobile and has particular application for workers who do not require a dedicated office.

9 Claims, 2 Drawing Sheets

46
16
14
38
18
52
50
40
46
48
20
12
32
33
34
35
36
30
8
4
22
2
11
6
24
72
26
19
10
19

FILE STORAGE TOWER STRUCTURE

FIELD OF THE INVENTION

The present invention relates to file storage towers and in particular, relates to file storage towers that have the capability of supporting office accessories to the exterior thereof.

BACKGROUND OF THE INVENTION

In many office environments today, there is a need to have greater flexibility with respect to file storage structures for use with free standing tables and work surfaces which are easily moved. In addition, file storage for private office furniture is not as efficient as file storage associated with panelling systems. For example, office panelling systems effectively use pedestal file cabinets and overhead bins. Shared office workstations or work tables which are available to workers when they are at a particular location also require effective storage. Although the workers are not always present, they typically retain some records and files at the location requiring a dedicated storage space. This storage space can take into account personal items that they prefer to use as well as limited storage of files of perhaps a mailbox or correspondence box where information can be left for their review upon their return. It is preferred to have these types of storage devices mobile so that they can be conveniently stored without interfering with the work table or workstation which will be shared with others.

The present invention provides improvements to storage structures used in the applications described above.

SUMMARY OF THE INVENTION

An office storage structure according to the present invention, comprises opposed rectangular side walls, a rear wall joining at the side walls, a bottom member joining the side walls and a top wall joining at the side walls. The side walls and the rear wall are joined to the periphery of the top wall and close the office storage structure from the sides, the rear, and the top, thereof. The office storage structure includes a peripheral edge at the top surface with at least one exposed rail member at this peripheral edge adapted to hang office accessories therefrom and to the exterior of the office storage structure.

According to an aspect of the invention, the at least one exposed rail member includes two exposed rail members positioned to opposite sides of the top member.

According to yet a further aspect of the invention, the at least one exposed rail member includes three opposed rail members, two of which are located on the sides of the top member and the third rail member being located at the rear of the top member, extending between the side walls.

According to yet a further aspect of the invention, the top member of the office storage structure at a rear edge thereof, and forward of the third exposed rail member includes a recessed channel configured to releasably retain a vertical support member suitable for maintaining books or binders supported on said top member in a vertical orientation.

According to yet a further aspect of the invention, the office storage structure is used in combination with an office bin configured for storage in the office storage structure and adapted to be supported from at least one rail exterior to the office structure.

According to yet a further aspect of the invention, the office bin includes a top edge having an outwardly extending flange with a bottom opening recess engageable with at least one rail for supporting said office bin to the exterior of the office storage structure.

According to yet a further aspect of the invention, the office storage structure includes a height adjustable shelf accessible at the front of the office storage structure and at least one of the shelves is adapted for supporting of the office bin.

According to yet a further aspect of the invention, the office storage structure can additionally support an office accessory such as a market board or a tack board, from any of the exposed rails.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
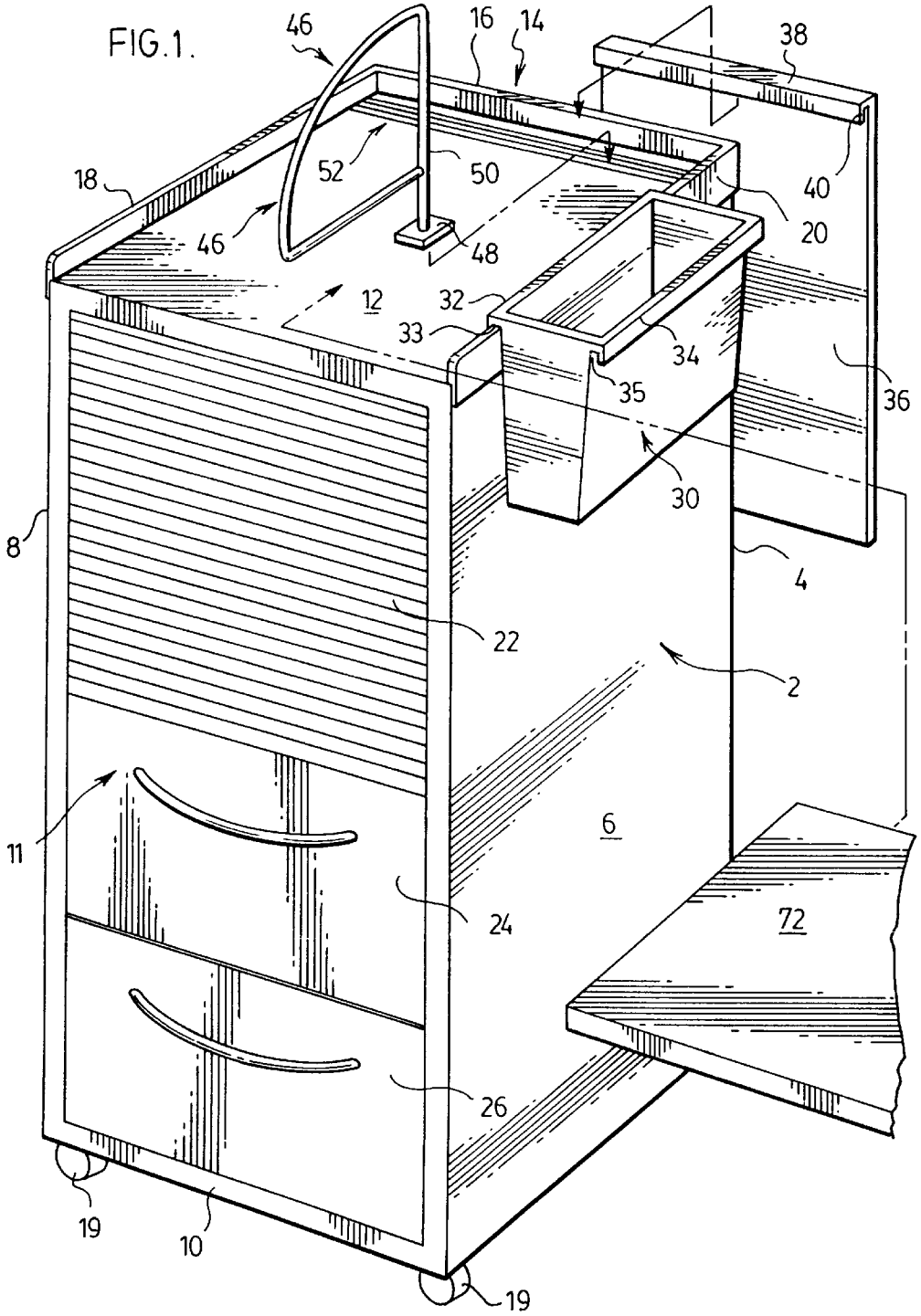
FIG. 1 is a perspective view of the office storage structure with an office bin supported to the exterior thereof.

The office storage structure 2 as shown in FIG. 1, has a rear wall 4, side walls 6 and 8, a bottom 10, a top surface 12, and an accessible front 11. The office storage structure is generally rectangular in configuration and is easily moved by a user due to the casters 19 or glides. The front 11 of the office storage structure has a tambour door 22 which opens upwardly to expose a shelf located behind the tambour door 22 dividing the upper part of the storage tower into two sections each adapted for receiving and storing office accessories such as the office bin 30. A single hinged door can replace the tambour door. Below this upper storage area are two pullout file drawers 24 and 26, for file storage. Two equal sized drawers are shown, however, it is possible to replace file drawer 24 with two box drawers for storage of personal items, pads, pencils, etc.

The top surface 12 has a peripheral edge 14, and side rails 18 and 20 are provided on the sides of the storage structure with an end rail 16 provided at the back edge of the top member. Each rail member protrudes upwardly from the top surface 12 and allows securement of office accessories such as the office bin 30 or the tackboard or whiteboard 36, from the rails and to the exterior of the storage tower. These office accessories are essentially hung from the rails and positioned to the exterior of the storage structure.

The office bin 30 is sized for receiving file folders and the bin can be stored within the storage structure by opening the tambour door 22 and locating the bin within a height adjustable recessed shelf adapted to receive and locate the bin. The shelf has a shallow panlike recess which limits rearward or forward movement of the bin once located in the storage structure.

The office bin 30 has opposed side flanges 32 and 34 having a downwardly opening recesses 33 and 35 for hooking over any of rail members 16, 18 and 20. In this way, the office bin 30 can be supported to the exterior of the storage structure as shown in FIG. 1 and this bin can also be stored within the storage structure when the user is away from the office.

It can also be seen from FIG. 1 that other office accessories can be hung from the rails 16, 18 and 20. A tackboard or whiteboard 36 is shown in FIG. 1 and has a top flange 38 with a downwardly opening recess 40 for allowing hanging on one of the rails as generally indicated in the drawing.

Figure 2:
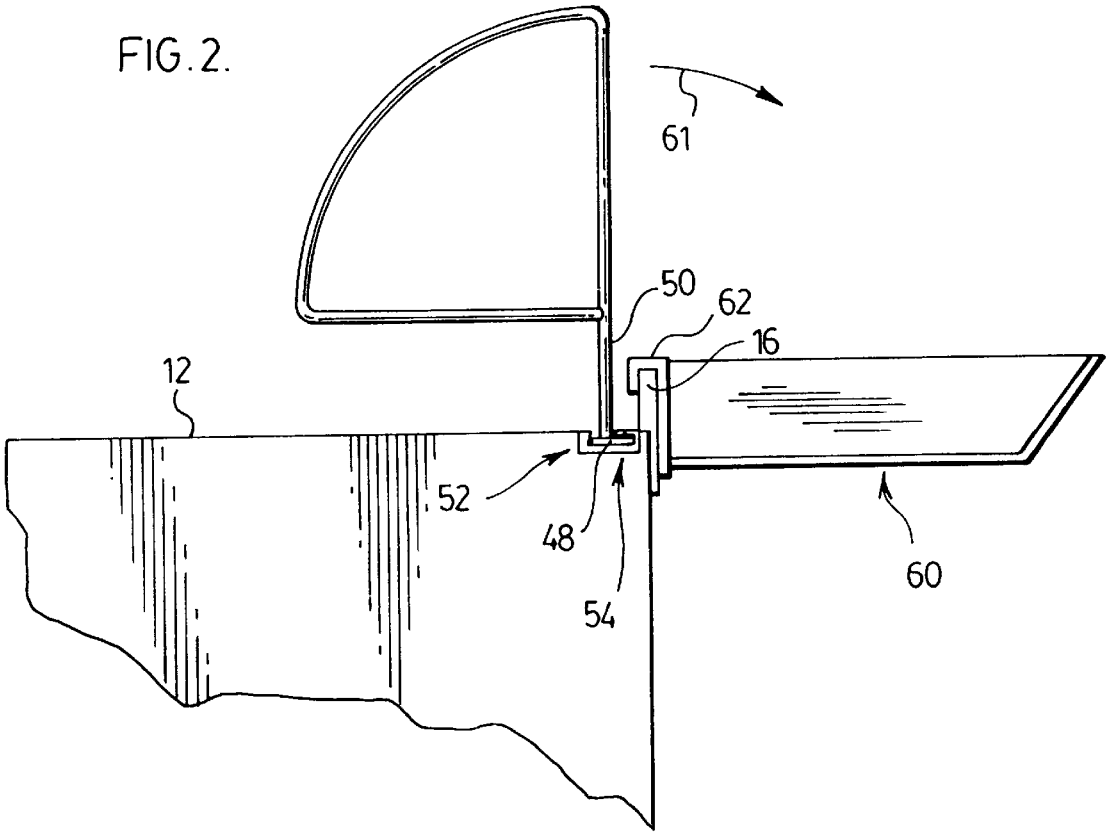
FIG. 2 is a view of the top member of the storage structure showing details of the rear rail and a recess channel provided at the back of the top member.

In FIG. 2, a paper tray office accessory is shown supported from the rails.

Other office accessories, such as a computer CD bin, slotted accessory rails for receiving other office accessories are aligned for support from these rails. The examples given of suitable office accessories are not meant to be limiting.

The rails 16, 18 and 20, also serve to retain material on the top surface. For example, books or binders are less prone to be accidentally knocked off.

The top surface of the storage structure adjacent the rear edge thereof has a recess 52 into which the extruded channel 54 is inserted and secured. The extruded channel is adapted to cooperate with the vertical support member 46 and in particular, the rectangular plate 48 cooperates with this channel. Secured to the rectangular plate is the bent upright portion 50.

Figure 3:
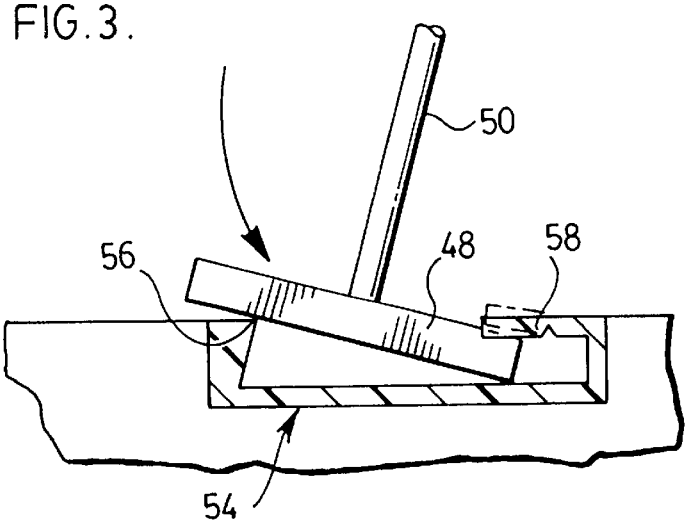
FIG. 3 shows a method of securing a vertical support member to a recess channel provided at the back of the top member.

The rectangular plate 48 in FIG. 3 is being inserted into the extruded channel 54 which has an undercut front edge portion 56 and a distorted rear edge 58 which cooperate with the channel to provide a restricted recess for releasably securing the rectangular plate 48. The rear edge of the rectangular plate is inserted into the channel and under the distortable rear edge 58 which moves upwardly allowing the plate to be inserted into the channel and snapped past the undercut front edge 56. To remove the vertical support member, the reverse action occurs where the upright is forced in the direction of rotation of arrow 61 of FIG. 2, allowing the front edge of the rear plate to move past the undercut front edge 56 and allow the rear plate to be removed from beneath the distortable rear edge 58.

The storage tower can have the vertical support members 46 secured on the top surface at any point along the rail, and provides convenient support for binders, books and other material. In some cases, it is more desirable to provide a finished top surface. In this case, any vertical support members 46 are removed and a decorative rectangular substrate shown as 72 in FIG. 1 is secured to the top surface, and in close proximity to the rails 16, 18 and 20. The substrate 72 can be sized to allow the clearance for hanging of the accessories or it can include a notched edge region along the sides and the back edge to accommodate the flanges of the various accessories for hanging on the rails. In most cases, the substrate 72 is slightly undersized to provide the necessary clearance for the hanging of the components. This substrate can be secured to the top surface by double-sided adhesive tape if desired or any other suitable arrangement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An office storage structure comprising opposed rectangular sidewalls, a rearwall joining said sidewalls, a bottom member joining said sidewalls and a top member joining said sidewalls, said sidewalls and said rearwall being joined to said top member such that said office storace structure is closed at said sidewalls, said top member and said rearwall, said office storage structure including at a peripheral edge of said top member at least one exposed rail member adapted to hang office accessories therefrom exterior to said office storage structure, said top member at a rear edge thereof includes a recessed channel configured to releasably retain vertical support members suitable for maintaining books or binders supported on said top member in a vertical orientation, said recessed channel being elongate and having opposed front and rear lips which extend partially into said channel providing undercut regions at either side of said recessed channel, and said vertical support members include a base portion adapted to be releasably retained in said recessed channel by locating said base portion in said channel and in said undercut regions, said office storage structure further including an office accessory adapted for hanging support from said at least one exposed rail.

2. An office storage structure as claimed in claim 1 wherein said at least one exposed rail member includes two exposed rail members positioned to opposite sides of said top member.

3. An office storage structure as claimed in claim 2 including a third exposed rail member at a rear edge of said top member and extending between said sidewalls.

4. An office storage structure as claimed in claim 1 in combination with an office bin configured for storage in said office storage structure and adapted to be supported from said at least one exposed rail exterior to said office storage structure.

5. An office storage structure as claimed in claim 4 wherein said office bin includes at a top edge an outwardly extending flange with a bottom opening recess engageable with said at least one rail for supporting said office bin to the exterior of said office storage structure.

6. An office storage structure as claimed in claim 5 wherein said office storage structure includes a plurality of shelves accessible at a front of said office storage structure and at least one of said shelves is adapted for support of said office bin.

7. An office storage structure as claimed in claim 1 wherein said office storage structure is configured for storage of said office accessory within said storage structure.

8. An office storage structure as claimed in claim 7 wherein said office accessory is marker board or tack board.

9. An office storage structure as claimed in claim 1 wherein said recessed channel is a plastic component.

* * * * *